US011365737B2

(12) United States Patent
Dollez et al.

(10) Patent No.: US 11,365,737 B2
(45) Date of Patent: Jun. 21, 2022

(54) OIL-INJECTED SCREW COMPRESSOR INSTALLATION IN WHICH COOLING MODULE IS OFFSET FROM COMPRESSOR ELEMENT

(71) Applicant: ATLAS COPCO AIRPOWER, NAAMLOZE VENNOOTSCHAP, Wilrijk (BE)

(72) Inventors: Yanni Francine Dollez, Wilrijk (BE); Kristof Adrien Martens, Wilrijk (BE); Steven Ray Maurits Laurent, Wilrijk (BE); Walter Josée Louis Adriaenssens, Wilrijk (BE); Brecht Van Ham, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 16/982,670

(22) PCT Filed: Mar. 25, 2019

(86) PCT No.: PCT/IB2019/052400
§ 371 (c)(1),
(2) Date: Sep. 21, 2020

(87) PCT Pub. No.: WO2019/197927
PCT Pub. Date: Oct. 17, 2019

(65) Prior Publication Data

US 2021/0017995 A1 Jan. 21, 2021

(30) Foreign Application Priority Data

Apr. 12, 2018 (BE) ..... 2018/5249

(51) Int. Cl.
*F04C 29/04* (2006.01)
*F04C 18/16* (2006.01)
(Continued)

(52) U.S. Cl.
CPC ..... *F04C 29/04* (2013.01); *F04C 18/16* (2013.01); *F04C 23/02* (2013.01); *F04C 29/026* (2013.01);
(Continued)

(58) Field of Classification Search
CPC ..... F04C 29/04; F04C 23/02; F04C 18/16; F04C 29/026; F04C 29/02; F04C 2/16; F04C 29/042; F04C 29/0007
See application file for complete search history.

(56) References Cited

U.S. PATENT DOCUMENTS 5,720,599 A * 2/1998 Myers ..... F01C 21/007 165/97
9,518,579 B2 * 12/2016 Scarpinato ..... F04B 53/18
(Continued)

FOREIGN PATENT DOCUMENTS

CN 101 354 158 A 1/2009
CN 102 997 510 A 3/2013
(Continued)

OTHER PUBLICATIONS

English Machine Translation of CN205190218U, translated by Espaceneton Sep. 7, 2021 (Year: 2016).*
(Continued)

*Primary Examiner* — Dominick L Plakkoottam
*Assistant Examiner* — Paul W Thiede
(74) *Attorney, Agent, or Firm* — Sughrue Mion, PLLC

(57) ABSTRACT

Oil-injected screw compressor installation including a frame or underframe (5 2), a screw compressor element (3), electrical cabinet (6), oil separator vessel (5) and an air-
(Continued)

cooled cooling module (8), with as characteristic that on one side (2*a*) of the frame (2), the screw compressor element (3) is placed horizontally and with the electrical 10 cabinet (6), the oil separator vessel (5) and the aircooled cooling module (8) being placed on the other side (2*b*) of the frame (2), with the cooling module (8) being placed such that this is perpendicular to the compressor element (3) and the air (9) sucked in by the cooling module 15 (8) will flow between the electrical cabinet (6) and the cooling module (8).

4 Claims, 4 Drawing Sheets

(51) Int. Cl.

| | |
|---|---|
| ***F04C 29/02*** | (2006.01) |
| ***F04C 23/02*** | (2006.01) |
| ***F04C 2/16*** | (2006.01) |
| ***F04C 29/00*** | (2006.01) |

(52) U.S. Cl.
CPC ..... *F04C 2/16* (2013.01); *F04C 29/0007* (2013.01); *F04C 29/02* (2013.01); *F04C 29/042* (2013.01)

(56) References Cited

U.S. PATENT DOCUMENTS

| | | | | |
|---|---|---|---|---|
| 10,316,845 | B2 * | 6/2019 | Kado | F04C 18/16 |
| 2008/0044307 | A1 * | 2/2008 | Koeck | F04C 28/08 418/201.1 |
| 2009/0041589 | A1 * | 2/2009 | Liebert | F04C 29/026 418/94 |
| 2010/0011803 | A1 | 1/2010 | Warnecker et al. | |
| 2010/0166571 | A1 * | 7/2010 | Van Den Wyngaert | F04C 18/16 417/44.2 |
| 2012/0210746 | A1 | 8/2012 | Kadle et al. | |
| 2016/0245289 | A1 * | 8/2016 | Kado | F04C 29/026 |
| 2017/0298937 | A1 * | 10/2017 | Seghers | F04C 28/24 |
| 2018/0283380 | A1 * | 10/2018 | De Vocht | F16K 11/08 |
| 2018/0291904 | A1 * | 10/2018 | Klaus | F01C 21/007 |

FOREIGN PATENT DOCUMENTS

| | | | |
|---|---|---|---|
| CN | 205 190 218 | U | 4/2016 |
| CN | 205 365 171 | U | 7/2016 |
| CN | 107 763 870 | A | 3/2018 |
| EP | 2 645 008 | A1 | 10/2013 |
| EP | 3 091 309 | A1 | 11/2016 |
| JP | 2016-191505 | A | 11/2016 |

OTHER PUBLICATIONS

International Search Report for PCT/IB2019/052400 dated Jul. 16, 2019 [PCT/ISA/210].
Written Opinion for PCT/IB2019/052400 dated Jul. 16, 2019 [PCT/ISA/237].
International Preliminary Report for PCT/IB2019/052400 [PCT/IPEA/409].

* cited by examiner

OIL-INJECTED SCREW COMPRESSOR INSTALLATION IN WHICH COOLING MODULE IS OFFSET FROM COMPRESSOR ELEMENT

CROSS REFERENCE TO RELATED APPLICATIONS

This application is a National Stage of International Application No. PCT/IB2019/052400 filed Mar. 25, 2019, claiming priority based on Belgian Patent Application No. 2018/5249 filed Apr. 12, 2018.

BACKGROUND OF THE INVENTION

Field of the Invention

The present invention concerns an oil-injected screw compressor installation.

Background

It is known that the known oil-injected screw compressor installations have a standardised layout with the various components always being placed in fixed positions relative to each other on a frame, framework or underframe in the casing.

These components include, among others, but not limited to: compressor element, cooler or cooling module, electrical cabinet, oil separator vessel, filters, valves and flaps, thermostats, dryer etc.

For known oil-injected screw compressor installations, the oil-injected screw compressor element is typically placed horizontally on one side of the underframe, with the electrical cabinet being placed together with the oil separator vessel and the cooling module on the other side of the underframe if it concerns a water-cooled cooling module.

Also, the positions of filters, valves, flaps and other control and service components are more or less determined.

In this way, the minimum pressure valve is placed on the oil separator vessel.

In the aforementioned electrical cabinet there are the distributor, the control module or control unit, possibly a frequency inverter and other needed electronics.

If the compressor installation is air-cooled, the air-cooled cooling module is either placed laterally over the compressor element, so that a warm and a cold compartment is created in the compressor element, which is needed for the proper functioning of the air-cooled motor, or aligned with the contour of the frame or underframe as a part of the casing, with appropriate air ducts having to be provided in order to send a correct cooling air flow to the air-cooled motor.

Such known set-ups have a number of disadvantages.

When the air-cooled cooling module is placed over the compressor element, the production or assembly of the compressor installation must proceed sequentially according to a specific order: first the compressor element, then placing the air-cooled cooling module over it.

The removal of the compressor element from the compressor installation can only be carried out by taking the compressor element from under the air-cooled cooling module, if the compressor element needs to be lifted, after the air-cooled cooling module is removed first.

When the air-cooled cooling module is aligned with the contour of the frame or underframe, it is not easy to remove the coolers from the cooling module for cleaning, and furthermore the noise emission is very high.

Yet another disadvantage is that, when the known oil-injected screw compressor installations include an integrated dryer, this is mounted on or in the underframe or frame of the compressor installation, as a result of which a larger frame must be provided for the compressor installations which include this dryer or there is an unused zone in the frame if only one, larger frame is provided for all compressor installations when the compressor installation does not include a dryer.

The present invention has the objective to provide a solution for at least one of the aforementioned and other disadvantages because it provides an oil-injected screw compressor installation with the various components of the compressor installation being positioned differently on the underframe or frame in the casing.

SUMMARY OF THE INVENTION

The present invention has an oil-injected screw compressor installation as subject including a frame or underframe, a screw compressor element, electrical cabinet, oil separator vessel and an air-cooled cooling module, with as characteristic that on one side of the frame, the screw compressor element is placed horizontally and with the electrical cabinet, the oil separator vessel and the air-cooled cooling module being placed on the other side of the frame, with the cooling module being placed such that this is perpendicular to the compressor element and the air sucked in by the cooling module will flow between the electrical cabinet and the cooling module.

In the aforementioned electrical cabinet there are, as mentioned already above, the distributor, the control module or control unit, possibly a frequency inverter and other needed electronics.

In the aforementioned air-cooled cooling module there are, for example, the following coolers: one or more oil coolers and one or more after-coolers for the compressed gas. Further, the air-cooled cooling module comprises one or more fans.

Another advantage is that due to the specific positioning of the air-cooled cooling module, with this extending perpendicular on the compressor element and with the air inlet facing the electrical cabinet, the air flow sucked in or the cooling air can be used as additional cooling for the electrical cabinet.

Further, the noise emission of the cooling module will be much lower.

Yet another advantage is that the coolers, such as, for example the oil coolers and the after-cooler, can easily be taken laterally from the air cooled cooling module.

An additional advantage is further that the cooling module does not block access to the compressor element and that during assembly or production of the compressor installation there is more freedom in the order of the placing of the various elements on the frame or underframe, so that it is possible to, for example, first place the cooling module and subsequently the compressor element.

Preferably, the oil-injected screw compressor installation is further provided with a valve manifold, in which all oil filters and thermostats are contained, with this valve manifold in a preferred variant being on the same side of the underframe as the screw compressor element.

This will ensure that all these components are at one easily accessible position which is, of course, advantageous for the assembly, maintenance and repair tasks.

In a practical embodiment, the oil-injected screw compression installation is further provided with a minimum pressure valve, with this minimum pressure valve being mounted on the after-cooler of the compressed gas, which after-cooler is in the air-cooled cooling module.

Since the minimum pressure valve in this embodiment is disconnected from the oil separator vessel, the maintenance and possible repairs or replacements of both the oil separator vessel and the minimum pressure vessel can be carried out more easily.

In a preferred embodiment, the oil-injected compressor installation is further provided with a dryer for drying the compressed gas which is assembled on a separate, additional underframe which is coupled to, or can be coupled to, the aforementioned underframe.

The coupling of the separate additional underframe can be carried out by, for example, screwing.

This has the advantage that only one "base" underframe or frame needs to be provided for all oil-injected screw compressor installations on which per necessity a separate, additional underframe for the dryer can be attached.

Yet another advantage concerns the fact that the oil-injected compressor installation at a later point in time, after installation of the compressor installation, can be easily provided with a dryer if needed. A separate, additional underframe with dryer can then be very easily attached to the frame or underframe.

Preferably, the screw compressor element is driven by an oil-cooled motor.

An advantage is that, due to the use of an oil-cooled motor, there is no need for a warm compartment and a cold compartment in the compressor element.

If an air-cooled motor were used, it will be necessary to place extra provisions in the form of extra plating or partitions to ensure that the motor is supplied with cold cooling air.

An oil-injected screw compressor installation according to the invention has the additional advantage that less and much shorter oil pipes and pressure pipes are needed.

BRIEF DESCRIPTION OF THE DRAWINGS

With the intention to better illustrate the characteristics of the invention, some preferential embodiments of oil-injected screw compressor installations according to the invention, are described below, as an example without any limiting character, with reference to the accompanying drawings in which:

FIG. 3 schematically shows a view according to the arrow F3 in FIG. 2;

DESCRIPTION OF THE INVENTION

Figure 1:
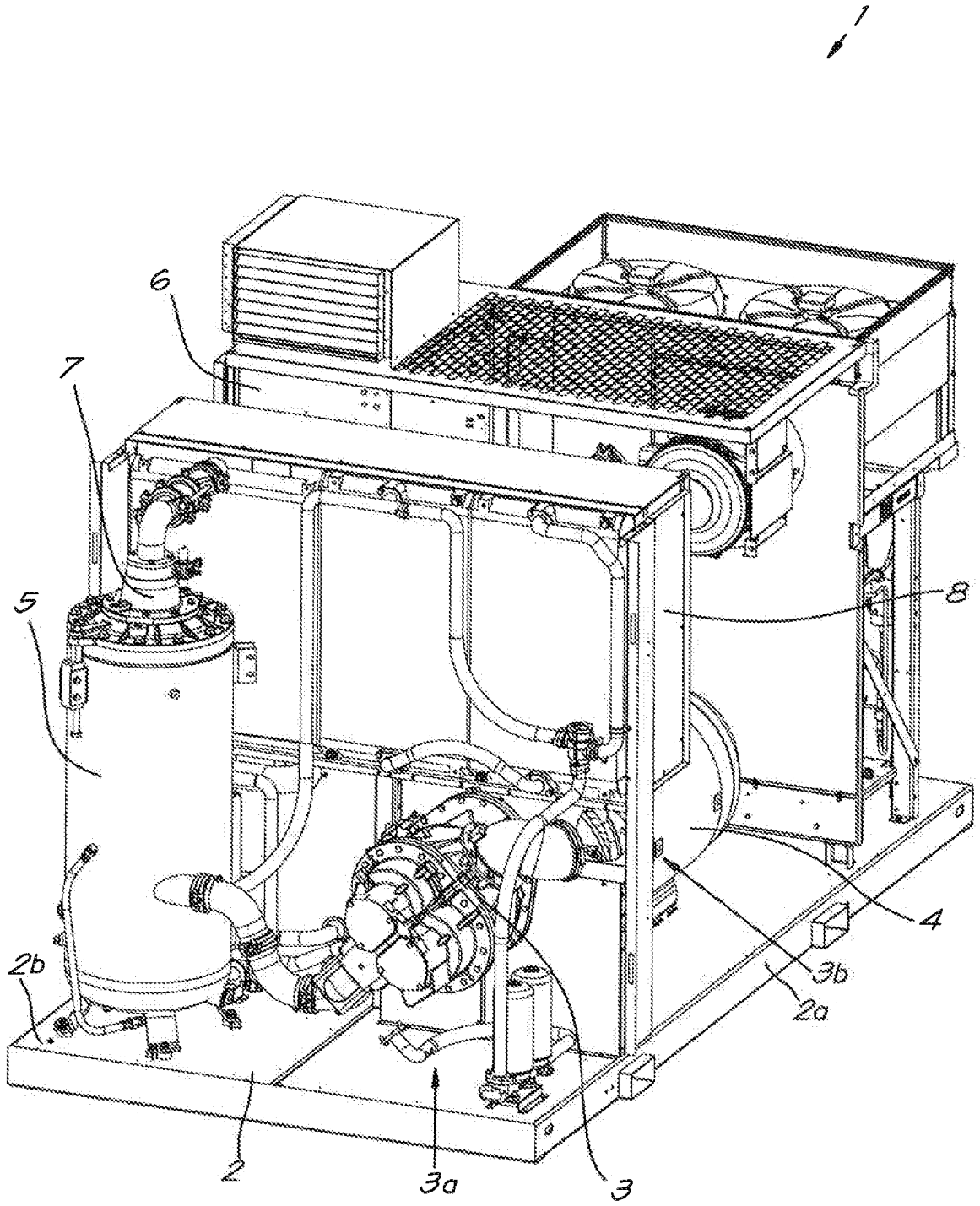
FIG. 1 shows schematically and in perspective a known oil-injected screw compressor installation.

The classic, known oil-injected screw compressor installation 1 shown schematically in FIG. 1 has the following set-up:

On one half 2*a* of the underframe or frame 2, the screw compressor element 3 is placed horizontally together with the motor 4 which is an air-cooled motor 4.

An oil separator vessel 5 and an electrical cabinet 6 are placed on the other half 2*b* of the frame 2.

The minimum pressure valve 7 is placed on the oil separator vessel 5.

There is further an air-cooled cooling module 8 provided which is placed laterally over the compressor element 3.

Due to this, a warm compartment 3*a* and a cold compartment 3*b* are created in the casing which is necessary for the air-cooled motor 4 to function well.

Further, filters, valves, thermostats and other control and service components are placed here and there in the oil-injected screw compressor installation 1.

At the same time, a lot of oil pipes and pressure pipes are needed to connect all of the components together.

It is possible that around all components of the oil-injected screw compressor installation 1, a casing is provided which has been omitted in FIG. 1 for the sake of clarity.

Figure 2:
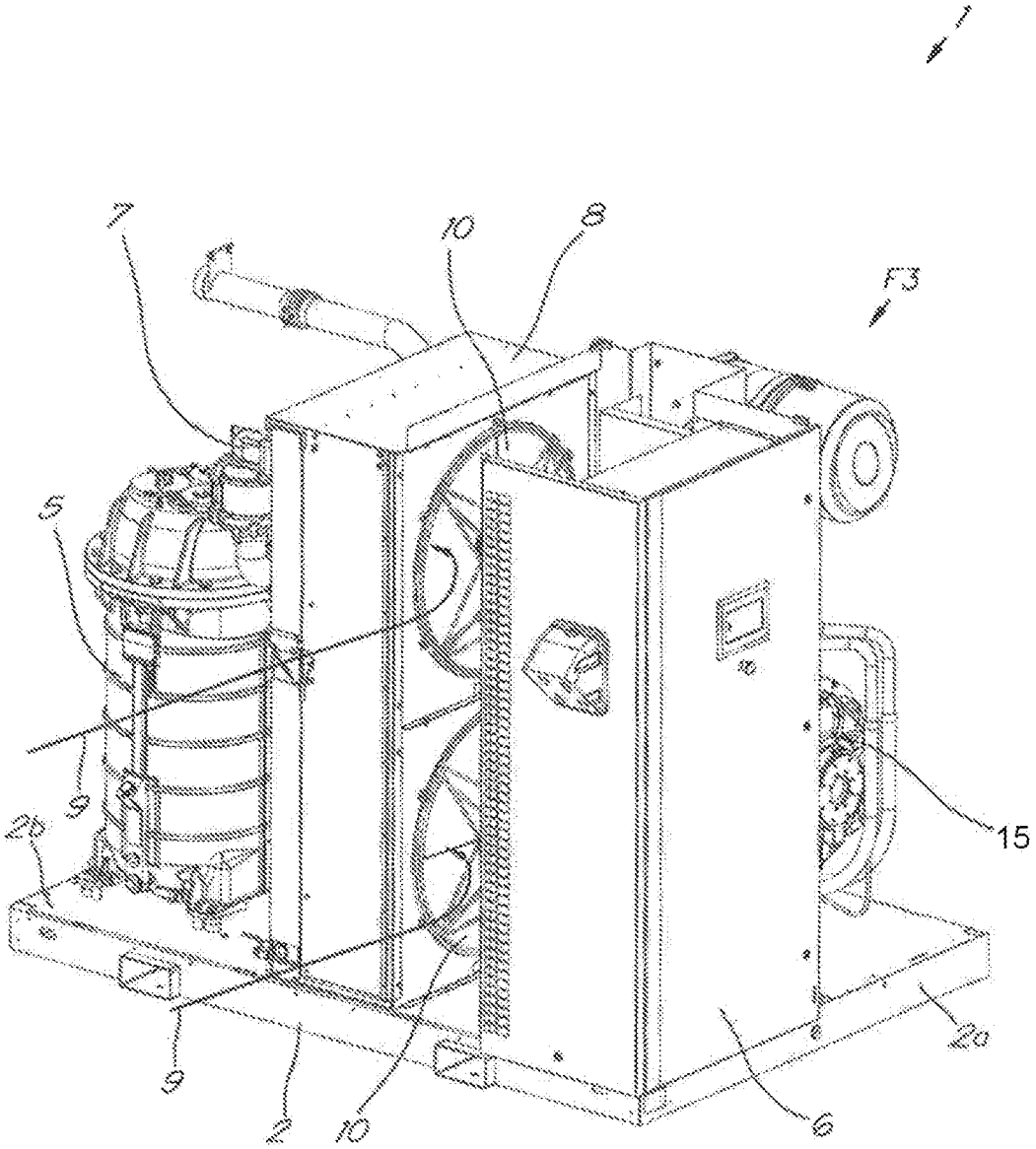
FIG. 2 shows schematically and in perspective an oil-injected screw compressor installation.
Figure 5:
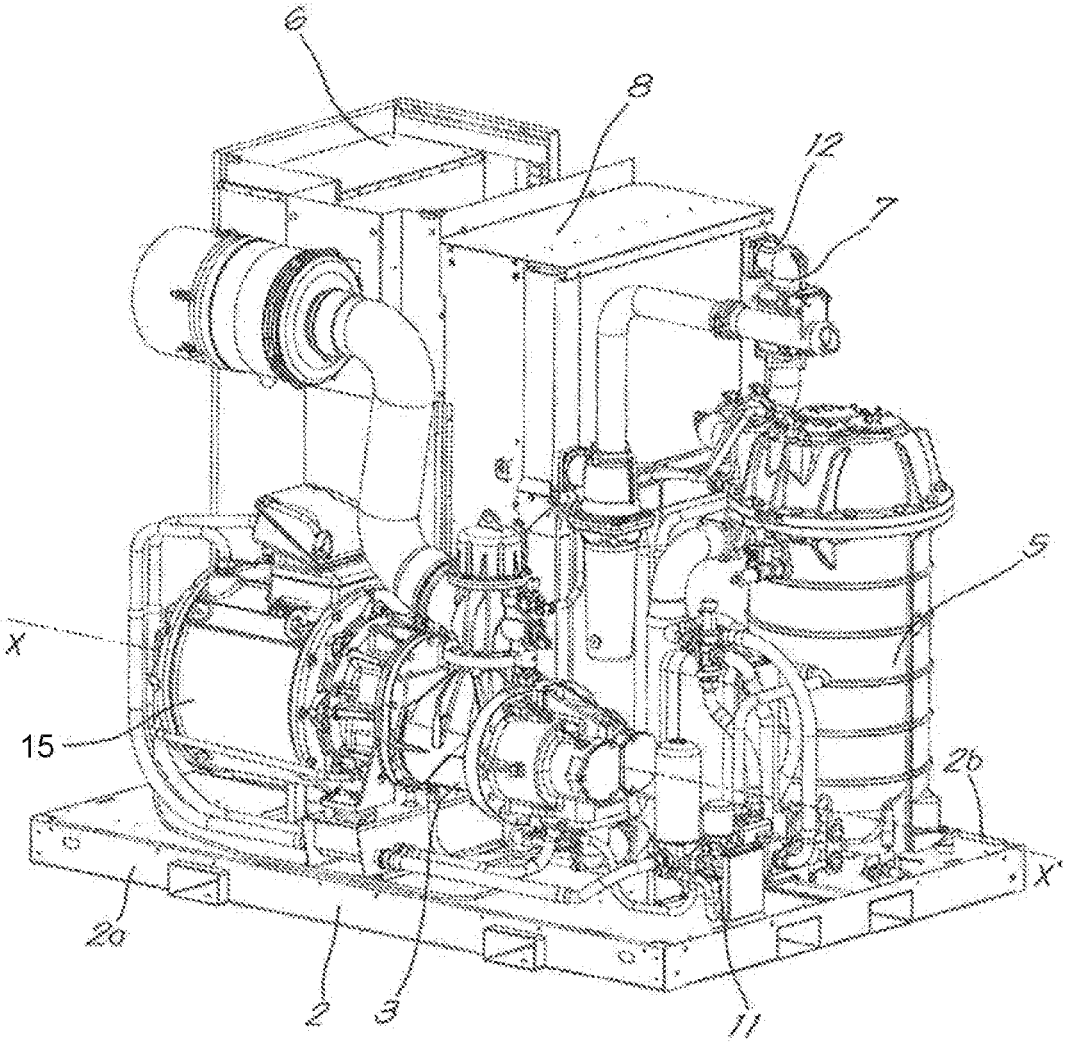

In FIGS. 2 and 3, an oil-injected screw compressor installation 1 according to the invention is shown with once again the casing being omitted for the sake of clarity.

The compressor installation 1 includes a frame 2 or underframe on which on one side 2*a* a screw compressor element 3 is placed horizontally.

According to the invention, this screw compressor element 3 is driven by an oil-cooled motor 15. The oil-cooled motor 15 is mounted against the screw compressor element 3.

Further according to the invention, the oil separator vessel 5 is provided on the other side 2*b* of the frame 2, together with the electrical cabinet 6 and the air-cooled cooling module 8.

The cooling module 8 is placed such that this is perpendicular to the compressor element 3, in other words: perpendicular to the longitudinal direction X-X' of the screw compressor element 3.

Further, the air 9 sucked in by the cooling module 8 will flow between the electrical cabinet 6 and the cooling module 8. This is shown schematically with the arrow 9.

It is important to mention here that the cooling module 8 does not extend over the compressor element 3 but is entirely located on the other side 2*b* of the frame 2.

Because of this, the cooling module 8 will be more easily accessible for maintenance, repair and/or replacement tasks, among others because it is closer to the ground.

Other advantages of such a set-up have already been explained above.

In this case, but not essential for the invention, the cooling module 8 includes one or more fans 10. These fans 10 will be responsible for sucking in the air 9.

Additional, but not essential for the invention, the screw compressor installation 1 is further provided with a valve manifold 11 in which all oil filters and thermostats are contained.

As can be seen in FIG. 3, this valve manifold 11 is in this case on the side 2*a* of the frame 2 just as the screw compressor element 3 is.

Also additionally, but not essential for the invention, the minimum pressure valve 7 is mounted on the air-cooled cooling module 8. In this case on the inlet 12 of the cooler for compressed gas from the air-cooled cooling module 8.

Figure 4:
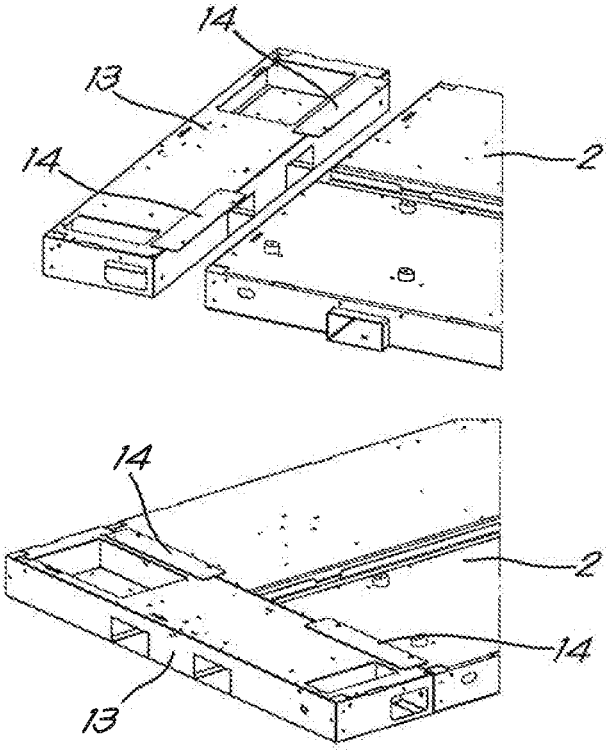
FIG. 4 shows schematically and in perspective, an additional underframe.

FIG. 4 shows a separate, additional underframe 13 with which the oil-injected screw compressor installation 1 from FIGS. 2 and 3 can be possibly equipped.

This separate, additional underframe 13 is intended for a dryer with which the compressed gas can be dried and which can be attached to the frame 2 of the oil-injected screw compressor installation 1.

As can be seen in FIG. 4, the separate, additional underframe 13 is provided with attachment elements 14 with which it can be screwed onto the frame 2 of the oil-injected screw compressor. It is clear that the attachment can also be done in different ways.

As is clear from the comparison of FIG. 1 with FIGS. 2 and 3, in an oil-injected screw compressor installation 1 according to the invention there are far fewer oil pipes and pressure pipes needed. This is due to the specific assembly or architecture or set-up of the oil-injected screw compressor installation 1 according to the invention with the special positioning of the air-cooled cooling module 8, the use of the valve manifold 11 and the location of the minimum pressure valve 7.

The present invention is in no way limited to the embodiments described as an example and shown in the figures, but an oil-injected screw compressor installation according to the invention can be realised in all kinds of shapes and sizes without falling outside the scope of the invention.

The invention claimed is:

1. An oil-injected screw compressor installation, comprising:

a frame (2), a screw compressor element (3), an oil-cooled motor (15), electrical cabinet (6), oil separator vessel (5) and an air-cooled cooling module (8), and a minimum pressure valve (7) mounted on the air-cooled cooling module (8), wherein:

the oil-cooled motor (15) and the screw compressor element (3) are disposed along an axis (X-X') on a first side (2*a*) of the frame in a longitudinal direction, the screw compressor element (3) being driven by the oil-cooled motor (15), the electrical cabinet (6) and the air-cooled cooling module and the oil separator vessel (5) are disposed along an axis in a longitudinal direction on a second side (2*b*) of the frame (2), the second side (2*b*) being opposite the first side (2*a*) in a lateral direction transverse to the longitudinal direction, the air-cooled cooling module (8) being located offset from the screw compressor element (3) in the lateral direction and extending from the frame (2), and air (9) flowing between the electrical cabinet (6) and the air-cooled cooling module (8) is sucked in by the air-cooled cooling module (8).

2. The oil-injected screw compressor installation according to claim 1, further comprising a valve manifold (11) in which all oil filters and thermostats are contained.

3. The oil-injected screw compressor installation according to claim 2, wherein the valve manifold (11) is on the first side (2*a*) of the frame (2).

4. The oil injected screw compressor installation according to claim 1, further comprising an underframe (13) configured to receive a dryer for drying the compressed gas, the underframe being coupled to the frame (2).

* * * * *